US006418870B1

(12) United States Patent
Lanowy et al.

(10) Patent No.: US 6,418,870 B1
(45) Date of Patent: Jul. 16, 2002

(54) TORPEDO LAUNCH MECHANISM AND METHOD

(75) Inventors: Michael J. Lanowy, Newport; Kenneth G. Sharpe, Bristol; David A. Lussier, Jamestown; Daniel M. Godfrey, Kingstown, all of RI (US); Mark A. Rodrigues, River, MA (US); Gary R. Berlam, Warwick, RI (US)

(73) Assignee: Systems Engineering Associates Corporation, Middletown, RI (US)

( * ) Notice: Subject to any disclaimer, the term of this patent is extended or adjusted under 35 U.S.C. 154(b) by 0 days.

(21) Appl. No.: 09/583,856

(22) Filed: May 31, 2000

(51) Int. Cl.[7] ..... F41F 3/10; B63G 8/28

(52) U.S. Cl. ..... 114/238; 114/318; 89/1.81; 89/1.818

(58) Field of Search ..... 114/238, 239, 114/316, 318; 89/1.818, 1.81

(56) References Cited

U.S. PATENT DOCUMENTS

| | | | |
|---|---|---|---|
| 1,681,434 A | 8/1928 | Richardson | |
| 2,426,610 A | 9/1947 | Hopkins | 89/1.7 |
| 2,700,356 A | 1/1955 | Hughes et al. | 114/20 |

(List continued on next page.)

OTHER PUBLICATIONS

Cipolla, "Pressure–Balanced Gas Generator Launchers for Underwater Use, Part II—Disclosure of Invention", May 3, 1995.

Cipolla et al., "Automotive Air Bag Infltor Pressure–Balanced Hybrid Gas Generator Submarine Acoustic Countermeasures Launcher, Part II—Disclosure of Invention", Sep. 30, 1998.

Allied–Signal Inc., Product description entitled "Allied–Signal Hybrid Inflators. Superior In Performance. Lower In Cost," 1991 Allied–Signal Inc.

Jeffrey L. Cipolla, et al., Use of Cots Gas Generators in Navy Launcher Applications, JANNAF Combustion Subcommittee Meeting, Monterey, Ca, Nov., 1996.

*Primary Examiner*—Charles T. Jordan
*Assistant Examiner*—John W. Zerr
(74) *Attorney, Agent, or Firm*—Wolf, Greenfield & Sacks, P.C.

(57) ABSTRACT

A retrofitable breech is disclosed for use on existing tubes for launching vehicles, such as torpedoes. The breech utilizes gas generators such as commercial off the shelf automotive airbag inflators, for propelling the torpedo from the tube. A plurality, typically three or four, generators are used and are fired in sequence with a controlled time delay. A retrofitable device is also disclosed for activating the weapons securing mechanism to release the torpedo. In addition, a release mechanism is disclosed for pulling the electrical connector plug on the torpedo. The sequence of releasing the torpedo, retraction of the plug and firing the inflators is controlled by a controller upon initiation of the firing sequence.

25 Claims, 15 Drawing Sheets

U.S. PATENT DOCUMENTS

| | | | | | |
|---|---|---|---|---|---|
| 2,980,053 | A | | 4/1961 | Endrezze | 114/238 |
| 3,064,538 | A | | 11/1962 | Leaman et al. | 89/1.7 |
| 3,137,203 | A | | 6/1964 | Brown | 89/1.7 |
| 3,182,554 | A | | 5/1965 | Barakauskas | 89/1.7 |
| 3,242,810 | A | | 3/1966 | La Pointe | 89/1.7 |
| 3,276,150 | A | | 10/1966 | Hamilton et al. | 35/25 |
| 3,298,278 | A | | 1/1967 | Barakauskas | 89/1.8 |
| 3,379,163 | A | | 4/1968 | Wiethoff | 114/238 |
| 3,548,708 | A | * | 12/1970 | Hubigh | 89/1.818 |
| 3,723,205 | A | | 3/1973 | Scheffee | 149/19 |
| 3,756,621 | A | | 9/1973 | Lewis et al. | 280/150 |
| 3,807,274 | A | | 4/1974 | Cohen | 89/1.81 |
| 3,895,821 | A | | 7/1975 | Schotthoefer et al. | 280/150 |
| 4,436,016 | A | | 3/1984 | Olmstead et al. | 89/1.809 |
| 4,590,860 | A | | 5/1986 | Kromrey | 102/289 |
| 4,643,072 | A | | 2/1987 | Hillebrecht | 89/1.81 |
| 4,665,791 | A | | 5/1987 | Bugiel | 89/1.1 |
| 4,671,163 | A | | 6/1987 | Erikson | 89/1.81 |
| 4,702,145 | A | | 10/1987 | Kannapell et al. | 89/1.803 |
| 4,944,210 | A | | 7/1990 | Flock et al. | 89/1.818 |
| 5,033,772 | A | | 7/1991 | Frantom et al. | 280/737 |
| 5,076,607 | A | | 12/1991 | Woods et al. | 280/737 |
| 5,345,876 | A | | 9/1994 | Rose et al. | 102/531 |
| 5,363,791 | A | * | 11/1994 | Stallard, III | 114/318 |
| 5,495,819 | A | * | 3/1996 | Marion | 114/238 |
| 5,551,368 | A | * | 9/1996 | Vire | 114/238 |
| 5,577,769 | A | | 11/1996 | Di Giacomo et al. | 280/736 |
| 5,589,141 | A | | 12/1996 | Sides et al. | 422/164 |
| 5,601,310 | A | | 2/1997 | Di Giacomo et al. | 280/741 |
| 5,666,897 | A | | 9/1997 | Armstrong | 114/20.1 |
| 5,747,730 | A | | 5/1998 | Scheffee et al. | 149/97 |
| 5,763,821 | A | | 6/1998 | Wheatley | 149/195 |
| 5,834,674 | A | * | 11/1998 | Rodriguez et al. | 89/1.81 |
| 5,850,053 | A | | 12/1998 | Scheffee et al. | 149/19.91 |
| 5,861,571 | A | | 1/1999 | Scheffee et al. | 102/288 |
| 5,918,307 | A | * | 6/1999 | Cipolla | 89/1.81 |
| 5,942,712 | A | | 8/1999 | Mello | 89/1.811 |
| 5,997,666 | A | | 12/1999 | Wheatley | 149/19.91 |
| 6,007,022 | A | | 12/1999 | Stallard, III | 244/63 |
| 6,164,179 | A | * | 12/2000 | Buffman | 89/1.81 |

* cited by examiner

| | |
|---|---|
| ARCITE MASS | 26g |
| ARGON VOLUME | 125mm X 70mm cyl. |
| ARGON PRESSURE | 2900PSI @ 70F |
| HELIUM% OF ARGON FILL | 2% BY VOLUME |
| SOLID ARCITE PRODUCTS | LiCl (45%), KCl (44%) |
| KCl MOLAR MASS | 74.56 |
| LiCl MOLAR MASS | 42.39 |
| GAS ARCITE PRODUCTS | $CO_2$ (33.4%), $H_2O$ (11.4%), $O_2$ (7.1%) |
| ARGON / HELIUM MASS | 182g |
| $\gamma$ | 1.561 |
| COMBINED GAS MOLAR MASS | 39.24 |

FIG. 12

| | | | | | LAUNCH CONFIGURATION | | | | | | PREDICTED/ACTUAL EXIT VELOCITY (ft/sec) | | | | | | TEMPERATURES | | | | | | | |
|---|---|---|---|---|---|---|---|---|---|---|---|---|---|---|---|---|---|---|---|---|---|---|---|---|
| VAL. TEST LAUNCH SEQUENCE | HIGH SPEED VIDEO # | TEST PLAN LAUNCH # | DATE TIME | EFFICIENCY (%) | LAUNCH VEHICLE | NO. GAS GENERATORS | GENERATOR TIME DELAY (ms) | BALLAST (Y/N) | WGT (LBS) | BLOWBY (SQ. IN.) | ENERGY PREDICTED VELOCITY | A-S PRE-TEST PREDICTED VELOCITY | A-S POST-TEST PREDICTED VELOCITY | EXIT VELOCITY (BENTLY PROBES) | EXIT VELOCITY (RADAR GUN) | EXIT VELOCITY (OPTICAL) | PEAK TEMP AFT TORP SKIN (°F) | PEAK TEMP PLENUM (°F) | PEAK TEMP FINS (°F) | PLENUM TEMP AT TOF (°F) | PEAK PRESS (PSIG) | PEAK ACCEL (G'S) | LAUNCHER/REXTORP DAMAGE | TALL DISTANCE FROM MUZZLE |
| 1 | | 1 | 10/13/97 1430 | 5.7 | Mk 50 | 4 | 20 | N | 419 | 10.3 | 43 | 39. | 44.2 | 43.1 | N/A | N/A | N/A | N/A | 200-250 | N/A | 80 | N/A | NONE | TUD |
| 2 | 1 | 2 | 10/28/97 1009 | 5.8 | Mk 46 | 3 | 20 | N/A | 485 | 8.2 | 34.6 | 34 | 33.7 | 33.4 | 35.5 | N/A | 200 | 175 | 200-230 | 111 | 65 | 18 | NONE | |
| 3 | 3 | 4 | 10/28/97 1300 | 7.3 | Mk 46 | 4 | 20 | N/A | 485 | 8.2 | 39.9 | 44 | 44.9 | 44.2 | 45.6 | N/A | 200 | 195 | 250-260 | 107 | 65 | 18 | NONE | |
| 4 | 2 | 3 | 10/29/97 0850 | 5.5 | Mk 46 | 3 | 20 | N/A | 485 | 8.2 | 34.6 | 34 | 33.7 | 32.3 | 32.5 | 33.3 | 150 | 134 | 200-250 | 79 | 65 | 17 | NONE | |
| 5 | 4 | 5 | 10/29/97 1132 | 9.3 | Mk 50 | 4 | 20 | N | 428 | 8.2 | 42.5 | 47 | 52.2 | 52.4 | 52 | N/A | N/A | 175 | 200-250 | 85 | 65 | 17 | NOTE 11 | |
| 6 | 5 | 6 | 10/29/97 1400 | 6.4 | Mk 46 | 4 | 40, 30, 20 | N/A | 485 | 8.2 | 39.9 | 41 | 42.2 | 41.3 | 41.8 | 39.2 | 185 | 210 | 200-250 | 104 | 52 | 12 | NONE | |
| 7 | | | 5/27/98 | | Mk 46 | 4 | 40, 30, 20 | | | | | | | 37.31 | | | | | | | | <20g | <20g | |
| 8 | | | 5/27/98 | | Mk 50 | 4 | 20 | | | | | | | 31.26 | | | | | | | | | | |

FIG. 13

TORPEDO LAUNCH MECHANISM AND METHOD

The U.S. Government has a paid-up license in this invention and the right in limited circumstances to require the patent owner to license others on reasonable terms, as provided for by the terms of contract No. N66604-97-C-2332 awarded by the Naval Undersea Warfare Center.

FIELD OF THE INVENTION

This invention relates generally to torpedo tubes for surface ships, and more particularly to an improved torpedo tube breech therefor and a method for launching torpedoes.

BACKGROUND OF THE INVENTION

The vast majority of surface ships worldwide utilize substantially the same mechanism and method for launching lightweight vehicles, such as torpedoes, from a tube. This technology was first developed in the 1950's, and has been utilized virtually unchanged since that time.

A conventional tube used for launching a lightweight vehicle, such as a torpedo, from a surface ship is schematically illustrated in FIGS. 1 and 2. In existing systems, the torpedoes are carried in a tube 10 disposed on the surface of the ship. Tube 10 is generally cylindrical in shape, and includes a discharge end 12 having a closure 16 and a breech end 14. A torpedo 18 with fins 13 is manually loaded into tube 10 through discharge end 12, upon opening of closure 16. Torpedo 18 resides in closely spaced relation with ridges or lands 15 on the side walls of tube 10. Ridges 15 are raised areas on the interior surface of the tube 10 which extend parallel to the long axis of the tube. Ridges 15 are designed not only to guide the fins 13 of the torpedo 18 but also to allow the body of the torpedo to fit snugly within the tube while allowing free passage of the fins 13. Ridges 15 also contribute to a pressure buildup upon launch, as they restrict the space within which the gas may escape in a forward direction.

Breech end 14 includes breech 20, and a weapons securing mechanism 24 for retaining the torpedo 18 within tube 10 during storage. Breech 20 is affixed to tube 10 by locking ring assembly 115, which comprises an interrupted screw mechanism. Rotation of locking ring assembly 115 allows opening of breech 20 and loading of a vehicle, such as a torpedo 18, into the breech end 14. Breech 20 includes a flask 22 and a control mechanism 26 responsive to a firing command for releasing the torpedo and expelling it from tube 10. Flask 22 contains air under high pressure. An air port 28 couples the interior of flask 22 to control system 26. Firing valve 30 permits air from within flask 22 to escape into tube 10 to expel torpedo 18, once valve 30 is opened. Weapons securing mechanism 24 includes jaws 32 which are configured to grasp a correspondingly shaped end tip 19 of the torpedo 18. Jaws 32 retain torpedo 18 in its desired position within tube 10 under normal, non-firing conditions. Jaws 32 are disposed within cylinder 31 which is slidably mounted. Cylinder 31 holds jaws 32 in their closed position grasping tip 19. Pressurized gas passed to port 27 from air port 28 by way of control system 26 causes cylinder 31 to move away from flask 22 (to the left as shown in FIG. 2) allowing the jaws 32 to open as the outer surfaces of the jaws 32 ride along sloped surface 33 of cylinder 31. Movement of cylinder 31 toward flask 22 closes jaws 32.

Firing valve 30 includes closure 34, sliding portion 36 and spring 38. Spring 38 biases sliding portion 36 against closure 34 into a normally closed position to prevent air within flask 22 from escaping to the interior of tube 10 under normal, non-firing conditions. A lever 40 is pivotally coupled to cylinder 31 at point 41, so that when cylinder 31 moves away from flask 22, lever 40 pivots and presses sliding portion 36 toward flask 22 and against the bias of spring 38 to unseat valve 30 and to allow air to escape into tube 10.

Tube 10 also includes an electrical connection 50 which provides electrical signals and power to torpedo 18 when it is being stored within tube 10. Electrical connection 50 includes an umbilical cable 52 and a plug 54 which is normally coupled to a correspondingly shaped female receptacle (not shown) in torpedo 18. Umbilical cable 52 is coupled to a lever arm 56 which is in turn coupled to a valve 58. When pneumatically actuated by air from control system 26, valve 58 pivots lever arm 56 to retract plug 54 from torpedo 18.

In operation, closure mechanism 16 is first opened to allow the torpedo 18 to pass through discharge end 12. When a command is received by control system 26 to fire the torpedo, air is bled through port 28 from the interior of flask 22 into control system 26 via a valving mechanism (not shown). The air from port 28 is conducted to port 58 to cause pivoting of lever arm 56 and thus retraction of plug 54. The air is then conducted through port 27 to cylinder 31 of weapons securing mechanism 24 causing jaws 32 to open, and lever 40 to pivot about pivot point 41. Lever 40 depresses sliding portion 36, opening firing valve 30 and releasing the high-pressure air from within flask 22 into the interior of tube 10. This air pressure is calculated to be sufficient to expel torpedo 18 from tube 10 once jaws 32 are opened to release end tip 19.

The structure and operation of the foregoing prior art torpedo tube and launching mechanism are fully described in Technical Manual SW395-AC-MMO-010/OP3355, NSNO640-LP-002-3000 entitled *Description, Operation, Maintenance, and Illustrated Parts Breakdown, Surface Vessel Torpedo Tube Mark* 32 *Mods* 5 *and* 7, which is published by direction of the Commander, Naval Sea Systems Command. The latest revision of this technical manual is dated Sep. 16, 1988, and is specifically incorporated herein by reference.

This prior art system has several drawbacks. In the first place, after a torpedo is manually loaded into tube 10 through breech end 14 after opening of breech 20, breech 20 must be recharged with high-pressure air. About 1600 lbs of air pressure are required for each flask 22. Therefore, it takes about one to one and one half hours to recharge the flasks for all six tubes that are normally carried on a typical ship. In adverse weather, the time required to recharge the flask in each tube can be potentially much longer. For those ships having tubes in external location outside the skin of the ship, the charging operation is also very hazardous if it must be performed in bad weather or in the dark. Some ship classes necessitate training the tubes outboard prior to charging. This recharge time produces a lengthy delay between the firing of one round of torpedoes, and readiness to fire the next round of torpedoes. Such a delay could prove disastrous in a combat situation.

Another drawback of the existing system is that all of the flasks presently found on most ships in the fleet have corrosion problems. As a partial consequence of these corrosion problems, the flasks do not hold the air charge indefinitely. They have to be recharged regularly, typically every 12–24 hours. Therefore, combat readiness could be affected by the failure to ensure that each flask remains fully charged.

Another problem associated with existing systems is that misalignment of the breech with respect to weapons securing mechanism 24 could and has caused accidental movement of lever 40 and opening of flask 22. Such an accidental opening could cause the breech to fly off while assembling the breech, or while charging the flask. Obviously, such a condition can be quite dangerous to the crew members who are involved in manually loading the tube and charging the flasks. Serious accidents have occurred during the removal and reinstallation of the air flasks, resulting in personal injury and loss of valuable man days, not to mention loss of combat readiness.

Also, all of the pneumatics associated with each tube are exposed to the salt atmosphere, and are subject to corrosion problems requiring frequent and intensive maintenance and repair.

SUMMARY OF THE INVENTION

The foregoing drawbacks of existing vehicle launch mechanisms for surface ships are overcome by the present invention, in which the air flasks in existing breeches are replaced by gas generators, which, in a preferred embodiment, are commercially available, automotive air bag gas generator inflators, that provide the energy needed to launch a vehicle, such as a torpedo, from a tube.

In one aspect of the invention, a new breech assembly is retrofitted on the breech end of an existing tube. This new breech is constructed with a retaining device containing a plurality of gas generators which are replaceable after use. This new breech assembly is retrofitted onto the existing locking ring assembly on the breech end of the tube. The retaining device provides adequate support for the gas generators to retain them in place during activation and allows rapid replacement of the gas generators after use.

In another aspect of the invention, a plurality of gas generators are employed and are activated sequentially with a predetermined time delay. This predetermined time delay produces a pressure wave of predetermined and predictable characteristics which expels the vehicle with the desired velocity and acceleration. By adjusting the number and sequence of the gas generators, the pressure wave developed by the prior art air flask can be easily replicated. This sequential firing of the gas generators preferably is electrically controlled.

In another further aspect of this invention, a cartridge is disclosed for activating the weapons securing mechanism to release the tip end of the vehicle, such as a torpedo, prior to launch. This cartridge is typically a small explosive device that can be retrofitted into the existing weapons securing mechanism pressure line to create the necessary gas pressure to open the jaws of the weapons securing mechanism.

In yet another further aspect of the invention, an improved umbilical release mechanism is disclosed for pulling the umbilical cable prior to launch. This improved umbilical release mechanism preferably is an electrically or pneumatically operated piston which pulls the existing umbilical cable in response to the launch signal.

By eliminating the need to use high-pressure air to launch a vehicle, such as a torpedo, this invention eliminates the time-consuming requirement of recharging the air flask following a launch. All that is required is replacement of the gas generators in the breech after loading of the vehicle, which can be accomplished in a relatively small amount of time. Since automotive air bag gas generators have been available for some time for automotive use, have a shelf life of 20 years, and have been demonstrated to be essentially leakproof, the risks of leaks are virtually non-existent. Thus, this invention also eliminates the need to continually recharge the flasks each 12–24 hours. Moreover, the leakage of air due to corrosion has been eliminated, and the risk of the breech flying off has also been eliminated, since high-pressure gasses are no longer used for the control mechanism.

As a consequence, the potential for injury is virtually eliminated. The tubes are always combat ready once the gas generators have been loaded, and the time required to render a particular tube firing ready after launch is substantially reduced. As a result, the ship can be maintained in a higher state of combat readiness than is possible with existing systems. Also, significantly less maintenance is required to maintain this combat readiness.

Finally, significantly, the implementation of this mechanism does not require replacement of existing tubes or changes in the method of loading or firing existing torpedoes. Rather, this improved breech mechanism can be retrofitted onto existing tubes utilizing the existing locking flange design and firing electronics. As a result, all existing hardware can still be used, including storage racks, handling equipment and launch computers. Also, most operational procedures can be maintained, or even eliminated as the reloading process is streamlined.

BRIEF DESCRIPTION OF THE DRAWINGS

The invention will be more fully appreciated from the following detailed description, when taken in conjunction with the accompanying drawings, in which:

FIGS. 12–15 are tables and charts related to certain parameters and the performance of the current invention.

DETAILED DESCRIPTION

Figure 1:
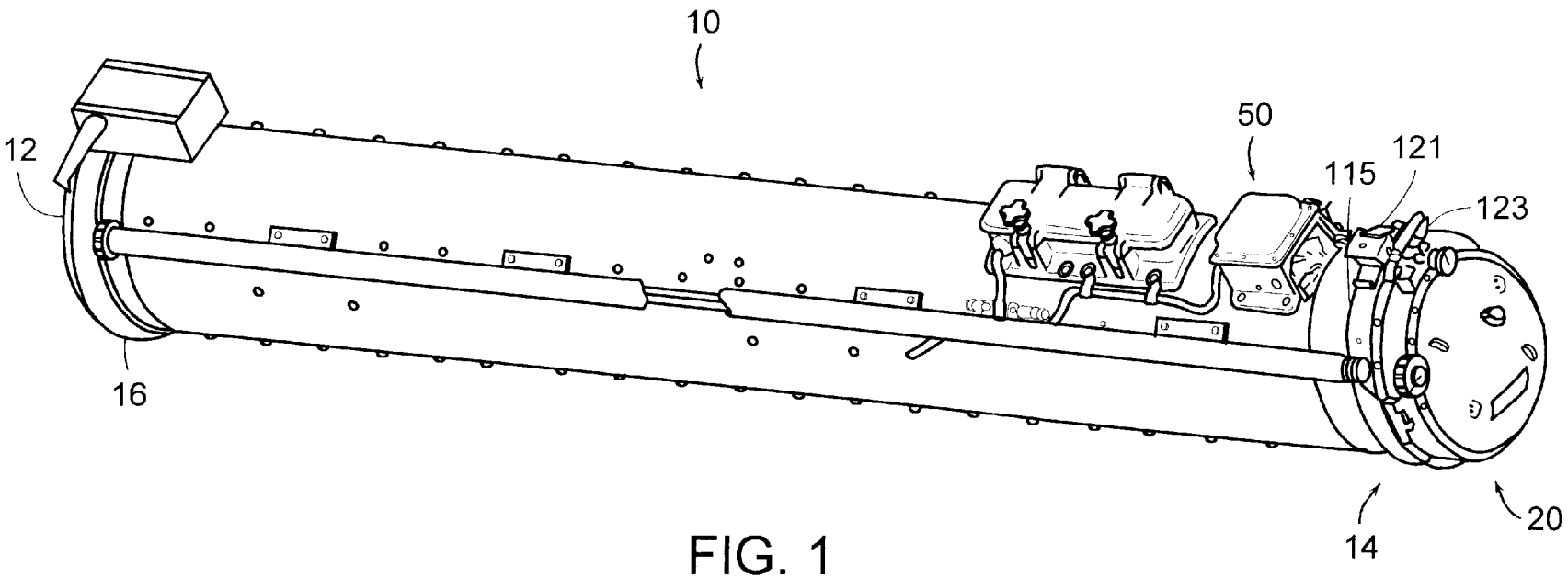
FIG. 1 PRIOR ART
FIG. 1 is a perspective, schematic view of a conventional vehicle launch tube.
Figure 2:
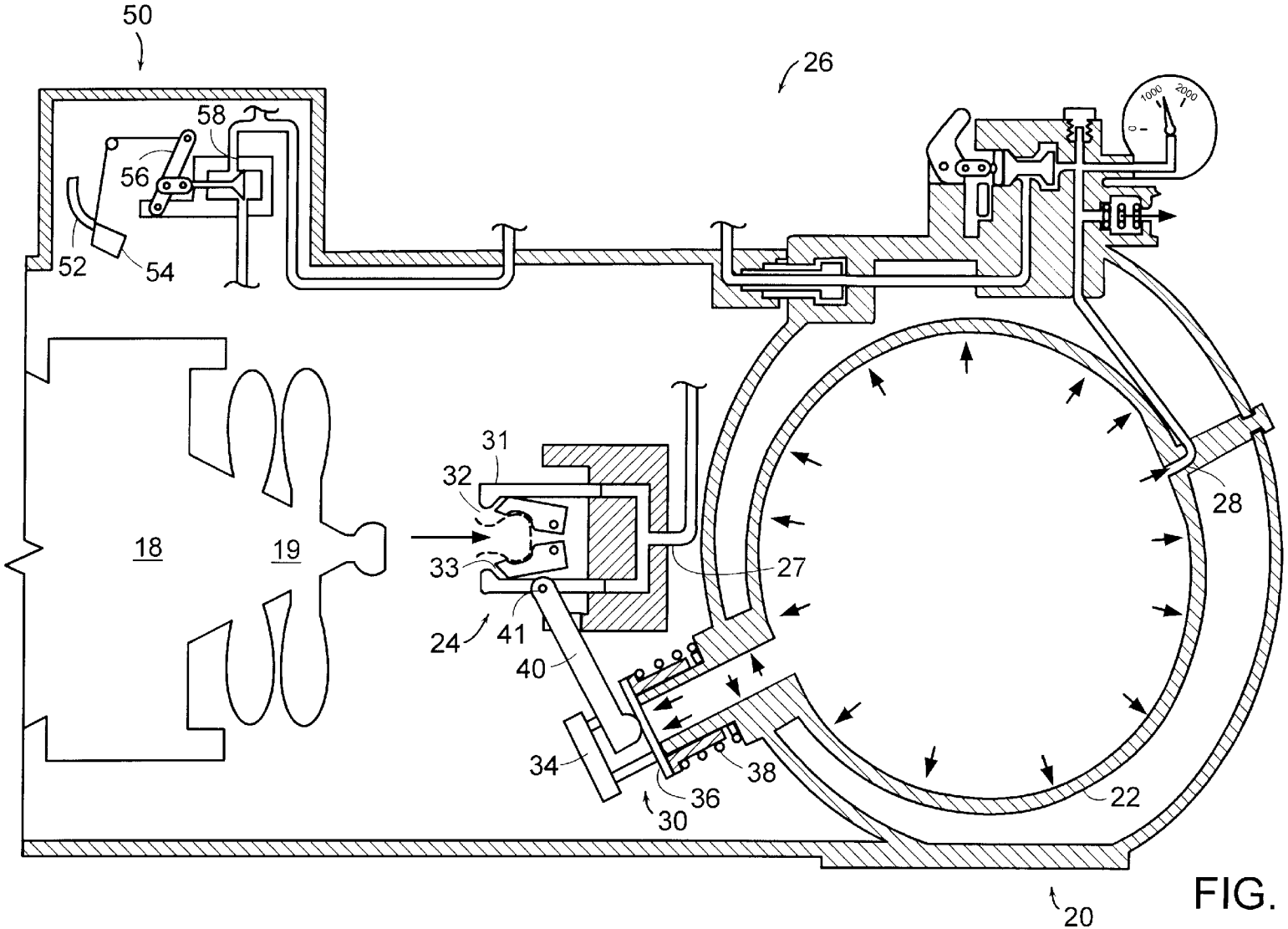
FIG. 2 PRIOR ART
FIG. 2 is a partial, cross-sectional, side schematic view of the tube of FIG. 1 illustrating the firing mechanism.
Figure 3:
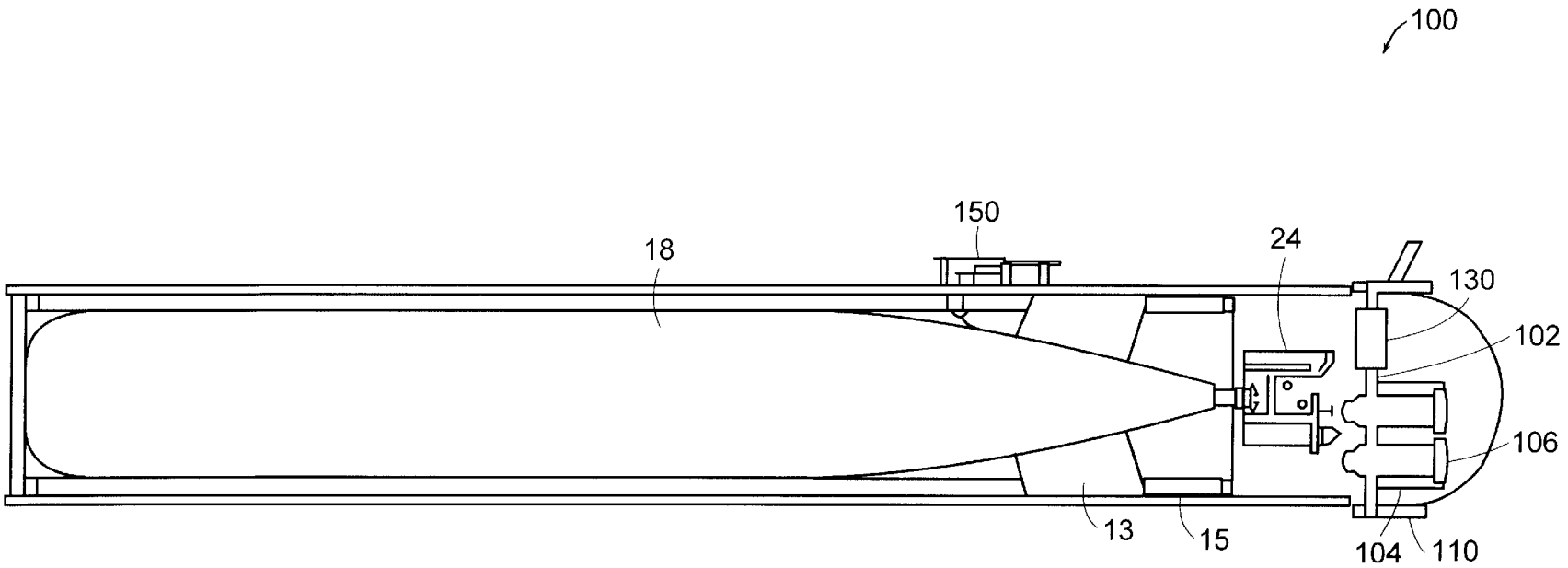
FIG. 3 is a cross-sectional side view of a tube in accordance with the present invention, illustrating the position of the vehicle prior to firing.
Figure 4:
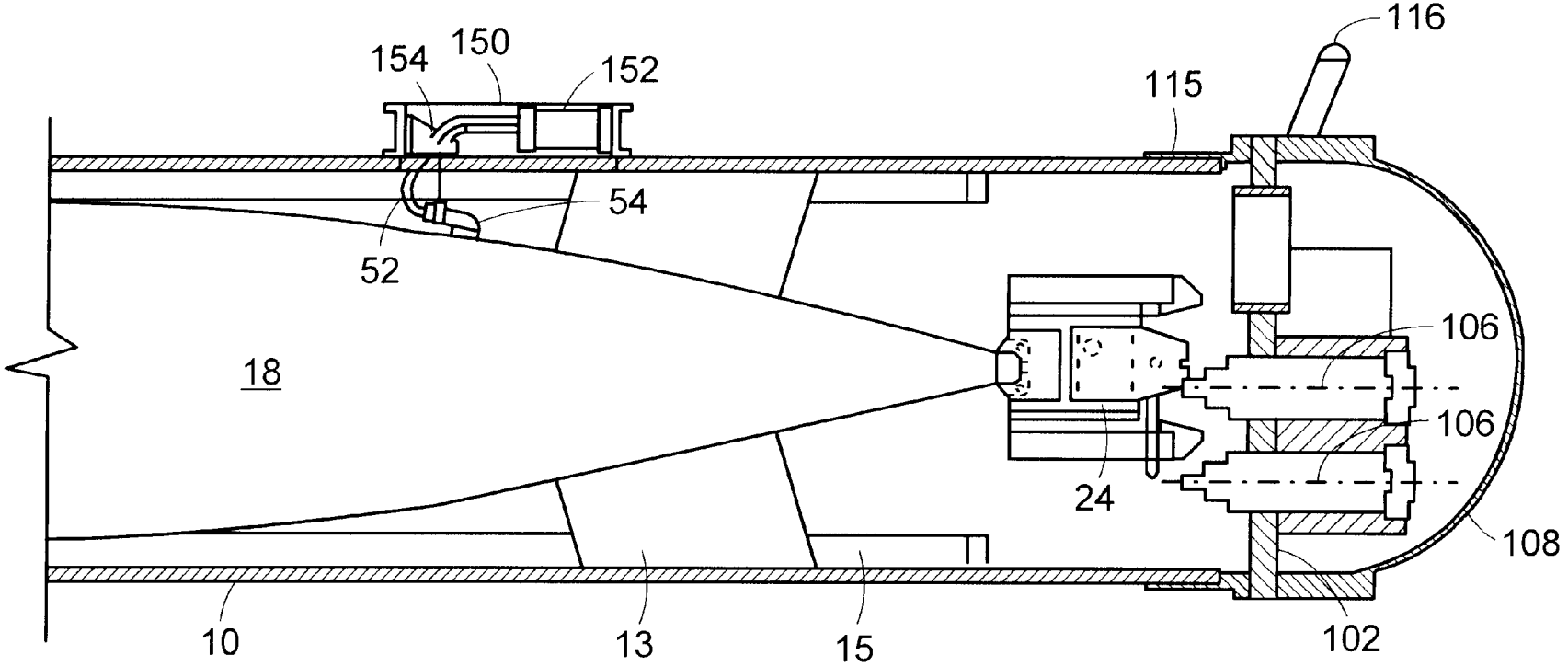
FIG. 4 is a partial, cross-sectional side view of the tube and vehicle of FIG. 3.

With reference now to the drawings, and more particularly to FIGS. 3 and 4 thereof, an exemplary embodiment of one aspect of the present invention will be described. Like numbers will be used for those elements of the novel launch mechanism which are identical or similar to those elements of existing, conventional launch mechanisms as illustrated in FIGS. 1 and 2.

FIG. 3 illustrates a vehicle disposed within tube 10. The vehicle typically is a torpedo 18 which has fins 13 riding between ridges 15 without contacting ridges 15. Tube 10 of FIGS. 3 and 4 is identical to tube 10 of FIGS. 1 and 2, except for the breech end, which will be described hereinafter. As shown in FIG. 3, end tip 19 of torpedo 18 resides within jaws 32 of weapons securing mechanism 24.

Novel breech assembly 100 of this invention includes breech plate 102, retaining device 104 mounted on breech plate 102, gas generators 106 disposed within retaining device 104, breech cover 108, locking flange 110 and controller 134.

Figure 5:
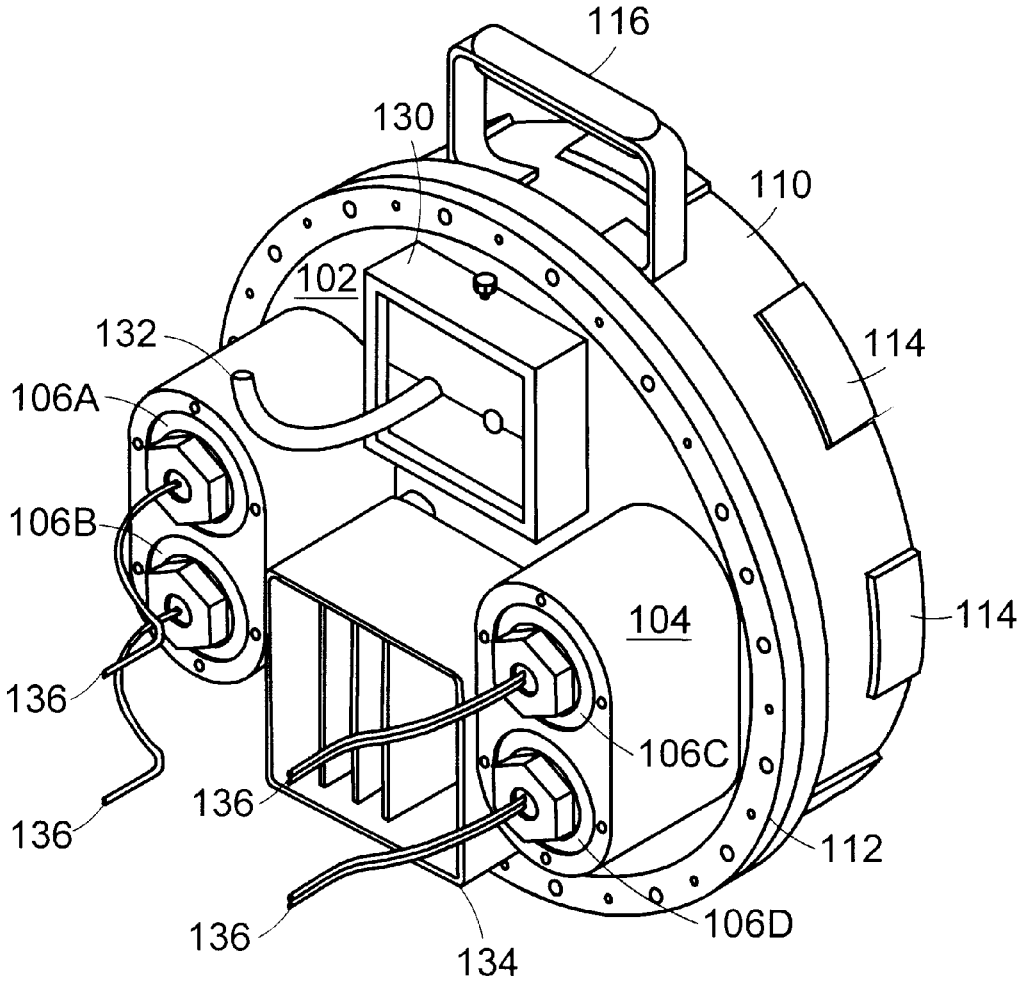
FIG. 5 is a perspective view of the breech plate and locking flange of the tube of FIG. 3.
Figure 6:
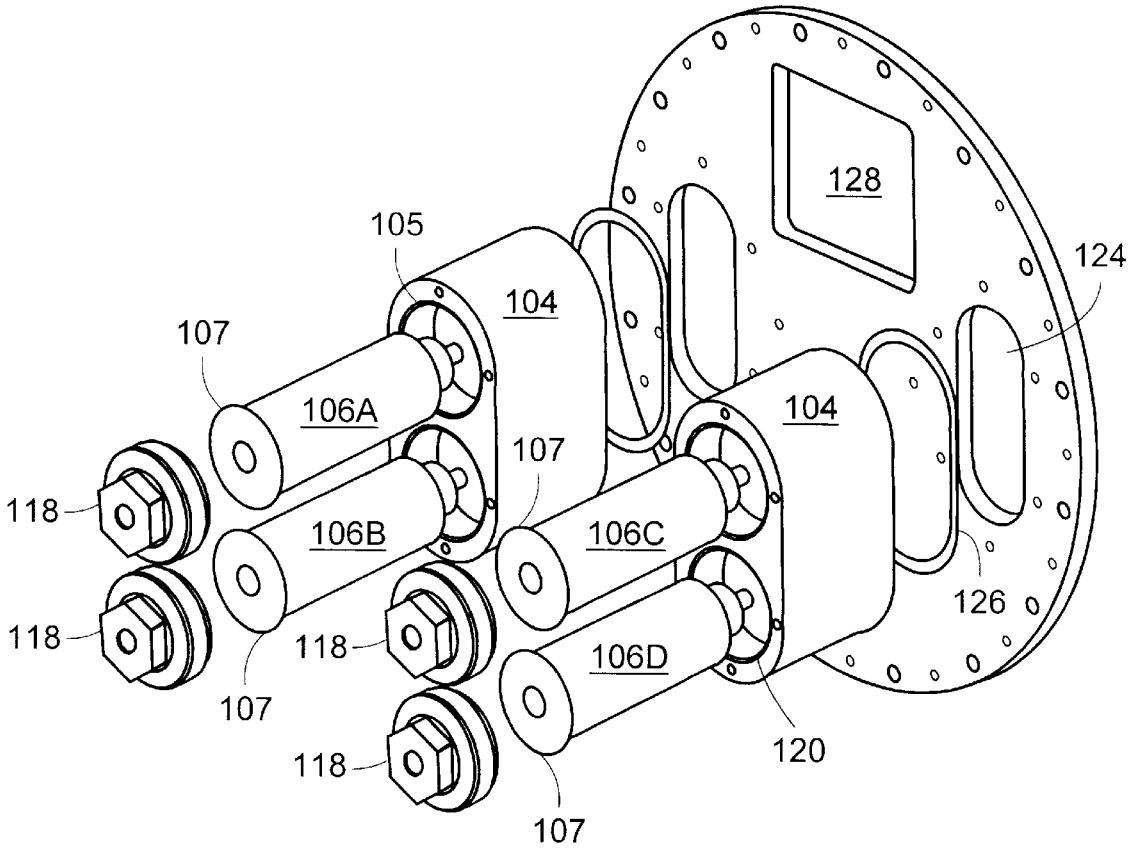
FIG. 6 is a perspective view of the breech plate of FIG. 5 illustrating insertion of the gas generators.
Figure 11:
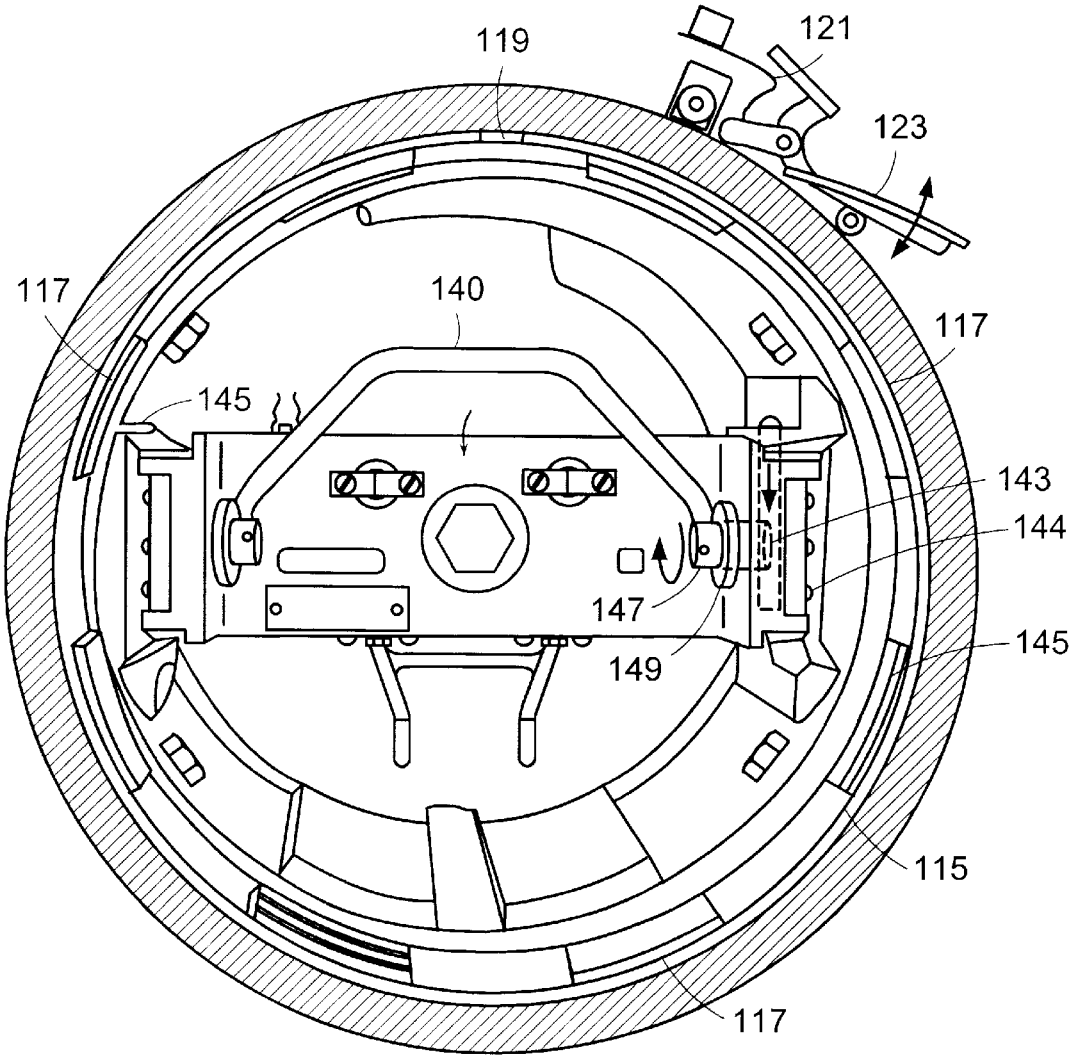
FIG. 11 is a cross-sectional view of the breach end of the tube of FIG. 3 taken along the line 11—11 of FIG. 9.

Breech plate 102 and locking flange 110 will now be described in more detail with particular reference to FIGS. 5, 6 and 11. Breech plate 102 is affixed by fixation devices 112 such as bolts, rivets or other suitable devices, to a locking flange 110. Locking flange 110 is similar to a locking flange used to mount breech 20 to tube 10 of a conventional system, as shown in FIGS. 1 and 2. Locking flange 110 includes raised, spaced locking elements 114 positioned at fixed intervals around the circumference of flange 110. These locking elements 114 form an interrupted screw when mated with a conventional rotatable locking ring assembly 115 on the breech end 14 of a torpedo tube 10. Locking ring assembly 115 contains mating, raised, spaced locking elements 117 disposed on an interior surface. When breech plate 102 and locking flange 110 are mounted onto the breech end 14 of tube 10, locking flange 110 is guided into the proper alignment by key 119 riding in a keyway (not shown), so that the spaces between locking elements 114 are aligned with but behind locking elements 117 on locking ring assembly 115. Thereafter, locking ring assembly 115 is rotated in a counterclockwise direction, as shown in FIG. 5, about the central axis of tube 10 approximately 22.5 degrees into a locked position in which the corresponding locking elements 117 of assembly 115 are aligned with elements 114 on the locking flange 110, and in which elements 117 are disposed on a side of elements 114 facing the inside of tube 10 to lock breech plate 102 and locking flange 110 on breech end 14. Locking ring grip handle 121 contains ball detents (not shown) which tell the operator when locking ring assembly 115 is in the locked or unlocked position and retain assembly 115 in a locked or unlocked position. Latch and bracket assembly 123 on handle 121 is clamped to assembly 115 to prevent rotation of ring assembly 115 from its locked position. The foregoing steps are reversed to remove flange 110 and breech plate 102 from tube 10. A handle 116 is provided on locking flange 110 to permit easy manual removal and replacement of the combination of locking flange 110 and breech plate 102.

Breech plate 102 has mounted on it, or incorporated into its structure, retaining devices 104. Retaining devices 104 include tubes 105 configured to accept gas generators 106 (106(*a*), 106(*b*), 106(*c*) and 106(*d*)) and their associated cables 136. Devices 104 are sufficiently sturdy, and are mounted to breech plate 102 in a sufficiently sturdy manner to allow devices 104 to sustain the high pressures generated by gas generators 106 and to direct all of the thrust forward into the interior of tube 10. Each tube 105 of each retaining device 104 is provided with a cover 118 which is threadably mounted, or mounted in some other suitable manner, on an opening 120 of tube 105. Cables 136 of gas generators 106 extend through openings in covers 118. For purposes of illustration only, breech plate 102 is illustrated as having two retaining devices 104 with four tubes 105. However, it is to be understood, that a smaller or greater number of retaining devices 104 and tubes 105 could be used, depending upon the launch requirements of a particular vehicle.

Gas generators 106 typically are inserted or replaced through opening 120. However, gas generators 106 could be inserted into tubes 105 from the other side of breech plate 102 through opening 124. The joint between device 104 and opening 124 is sealed with an O-ring or other like seal 126 to render the joint gas tight. Gas generators 106 each preferably have an enlarged lip 107 adjacent cover 118. Lip 107 together with a very snug fit of gas generators 106 within tubes 105 seal the opening in cover 118 for cables 136 and prevent any leakage of gases through cover 118.

Breech plate 102 also includes opening 128 through which cable transit 130 extends in a gas tight relationship. Cable transit 130 permits electrical control cables 132 to extend therethrough. An acceptable cable transit 130 can be purchased commercially from Nelson Firestops under model no. RGS-2 Also mounted onto the breech plate 102 is a controller 134 which controls the firing sequence of gas generators 106 and other aspects of the tube 10. Controller 134 is coupled to each gas generator 106 by its cable 136, and is coupled to weapons securing mechanism 24 and release mechanism 150 by cables 132. Controller 134 preferably is hard-wired, but could also be programmable.

Figure 7:
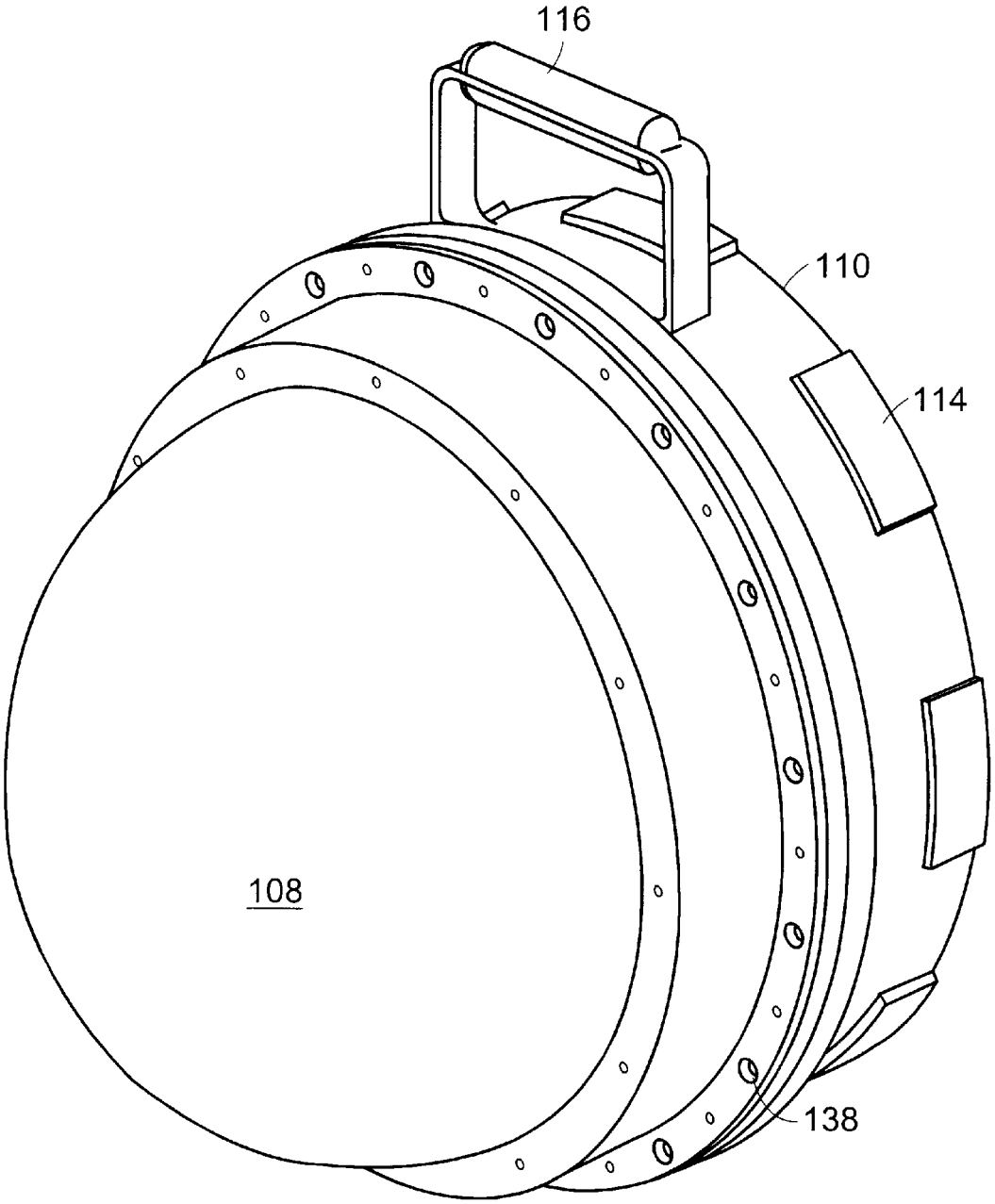
FIG. 7 is a perspective view of the breech cover and locking flange of the tube of FIG. 3.

Breech cover 108 covers breech plate 102 and all of the foregoing elements mounted thereon. Breech cover 108 seals the breech end of tube 10. As illustrated in FIG. 7, breech cover 108 is secured to breech plate 102 by bolts, rivets, quick release mechanisms, or other suitable mechanisms 138. Mechanisms 138 permit removal of breech cover 108 to allow ready access to devices 104 and breech plate 102.

Figure 8:
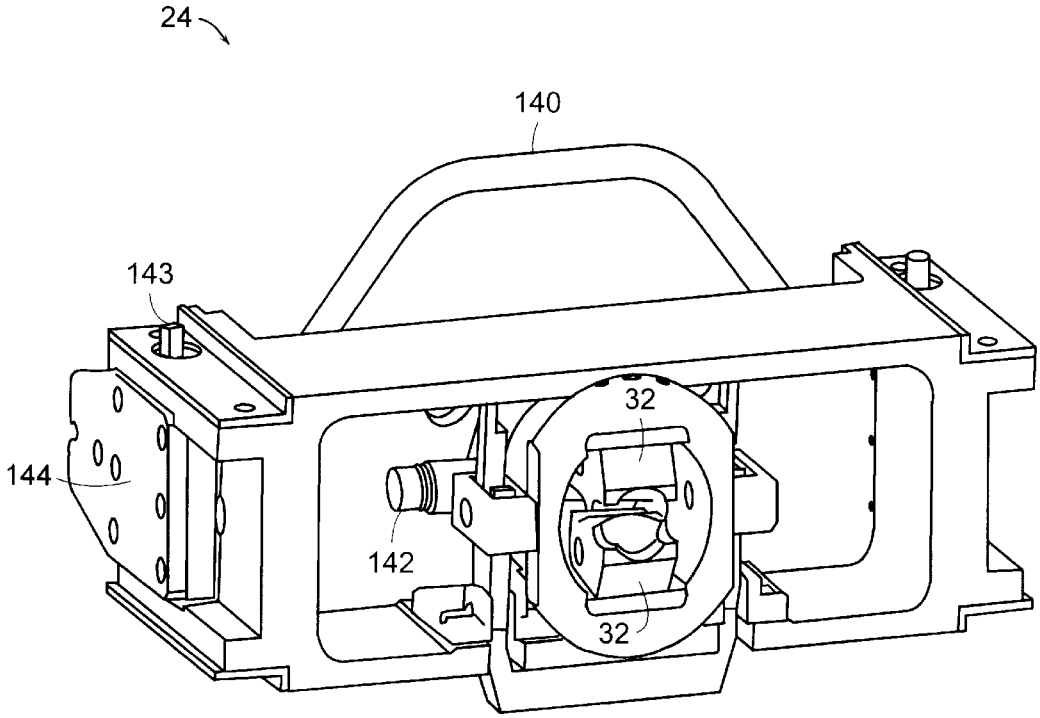
FIG. 8 is a perspective view of the weapon securing mechanism of the tube of FIG. 3.
Figure 9:
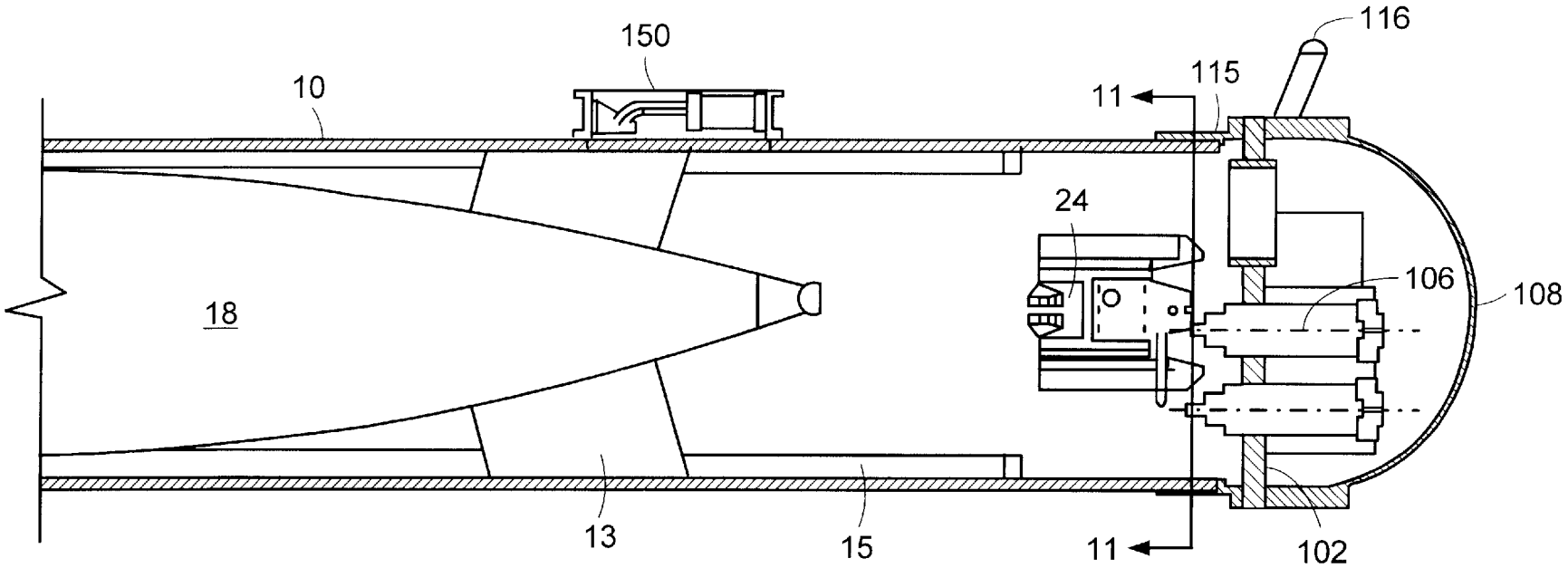
FIG. 9 is a partial, cross-sectional view of the tube of FIG. 3 illustrating the vehicle exiting the tube after firing.

Weapons securing mechanism 24 will now be described with particular reference to FIGS. 8 and 11. Weapons securing mechanism 24 of the present invention is substantially identical to that found in existing tubes 10, and includes jaws 32 which are configured to engage and restrain tip 19 of torpedo 18, a handle 140 to allow for easy manual replacement and mounting plates 144. Tube 10 includes mounting brackets 145 disposed on opposed interior walls. Mounting plates 144 of weapons securing mechanism 24 are insertable into brackets 145, as shown in FIG. 11, and include pins 143 which are slidably disposed within plates 144. Pins 143 are configured and structured to extend into correspondingly formed openings in bracket 145 to retain weapons securing mechanism 24 within brackets 145. Handle 140 is pivotally secured to mounting plates 144 at pivots 147 which permit handle 140 to be pivoted approximately 180 degrees, from the position shown in FIG. 11 or in an upwardly facing direction, to a position facing downwardly in FIG. 11 toward the bottom of tube 10. Pins 149 coupled to handle 140 at pivots 147 engage pins 143 in a known manner, such as through a conventional camming or gearing mechanism to move pins 143 upwardly into the openings in bracket 145 or downwardly to withdraw pins 143 from the openings, in response to pivoting of handle 140. As shown in FIG. 11 with handle 140 facing in an upward direction, pins 143 have been moved upwardly to extend into corresponding openings formed in brackets 145 to lock mechanism 24 into brackets 145. When handle 140 is pivoted in a downwardly direction, as shown by the arrow in FIG. 11, pins 143 are moved downwardly to be withdrawn from the openings in brackets 145 to permit removal of mechanism 24. When mechanism 24 is inserted into tube 10, it is inserted into brackets 145 from the breech end 14 with handle 140 pointing downwardly. Thereafter, handle 140 is manually raised to lock mechanism 24 into place. Handle 140 also permits manual grasping and deployment of mechanism 24.

The weapons securing mechanism 24 of the present invention does not include firing valve 30 of the prior art. In the present invention, in one embodiment, port 27 of weapons securing mechanism 24 is coupled to an initiator 142, rather than to the control system 26 of the prior art. Initiator 142 is in turn electrically coupled to controller 134 by cables 132. Actuation of initiator 142 generates a gas under pressure which is coupled to port 27 by direct physical connection of initiator 142 to port 27. The gas emitted from initiator 142 causes jaws 32 to open in the same manner that gas received from control system 26 caused jaws 32 to open in a conventional launch mechanism. Initiator 142 must be replaced after each firing of a torpedo 18.

Initiator 142 preferably develops a force of about 1600 psi±200psi in a 16 $cm^3$ volume. This pressure is sufficient to activate jaws 32. Any type of device that develops such a gas pressure will suffice for initiator 142, so long as it can be readily activated and so long as no toxic fumes are released. Typically, initiator 142 may be a small cartridge which contains an explosive device. A preferred initiator 142 is the firing device used on missiles, particularly a Tomahawk missile. This device can be purchased from Special Devices, Inc., 16830 West Placerita Canyon Road, Newhall, Calif. 91321 under part number 103377-32.

Figure 10:
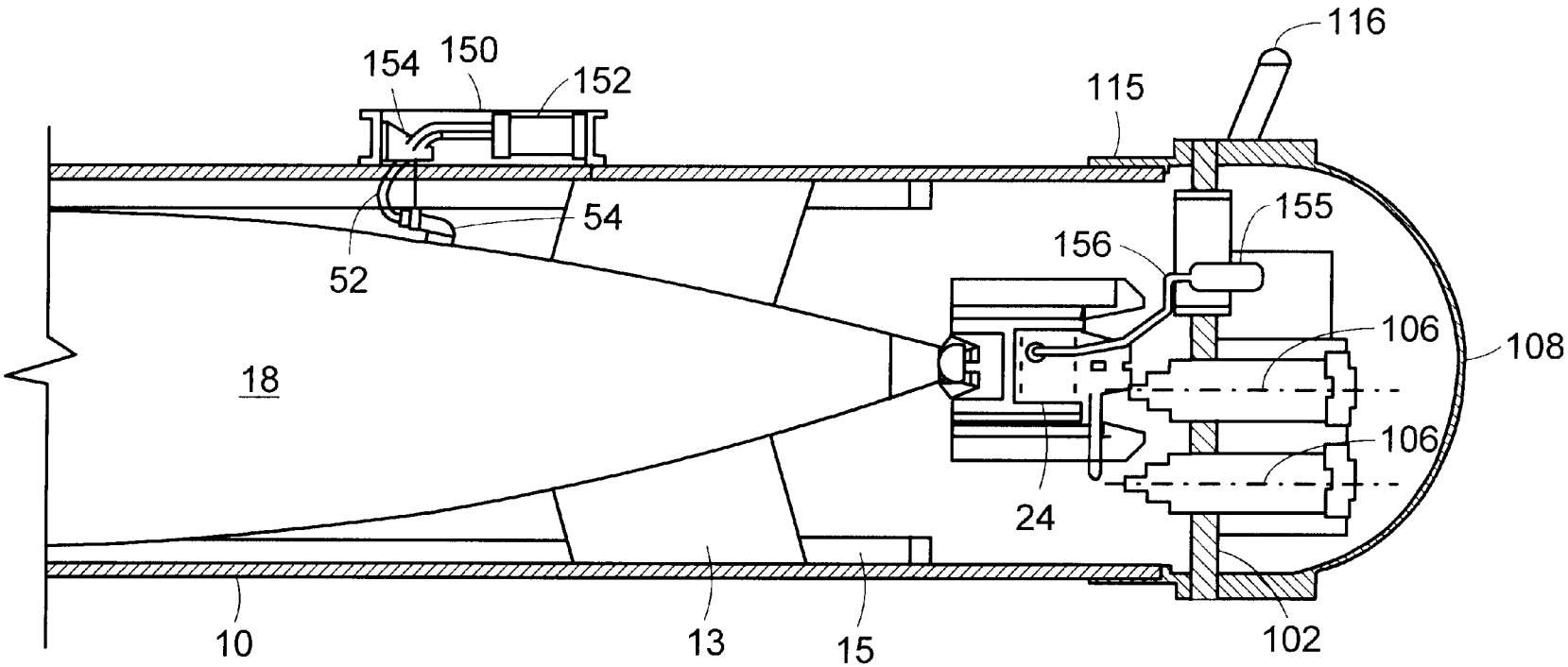
FIG. 10 is a partial, cross-sectional side view of the tube and vehicle of FIG. 3 illustrating another embodiment of this invention.

In an alternative embodiment, as illustrated in FIG. 10, a separate gas generating device 155 is mounted in breech plate 102 and is fluidly coupled to port 27 by a hose 156 or the like. Device 155 may be similar to initiator 142 or it may be a carbon dioxide cartridge, or any other source of pressurized gas. Device 155 would be replaced with gas generators 106 in the same operation, such as by completely removing and breech plate 102 and replacing it with a new breech plate 102 containing fresh gas generators 106 and a device 155. In a further alternative embodiment, hose 156 could be fluidly coupled to a gas generator 106 so that port 27 is directly coupled to the gas issuing from gas generator 106. Gases emitted from gas generator 106 activate jaws 32 to open them in the same manner as in the prior art.

As in conventional tubes 10, there is an umbilical cable 52 and associated plug 54 which is normally inserted to a correspondingly-shaped female receptacle (not shown) in torpedo 18. Cable 52 provides control signals and power to torpedo 18 when stored within tube 10. Umbilical release mechanism 150 of the present invention preferably includes an electrically actuated cylinder 152, such as a solenoid. Cylinder 152 could also be pneumatically actuated, or cylinder 152 could be activated by gases received from gas generators 106. Cylinder 152 is coupled by arm 154 to cable 52. Actuation of cylinder 152 by controller 134 causes a pulling action on cable 52 to pull plug 54 from the female receptacle in torpedo 18.

As used herein, the term "gas generator" is defined as including any replaceable, self contained, sealed device that generates non-toxic, non-corrosive gases under pressure in a controlled manner either as a by-product of a chemical reaction or through release of a stored compressed gas, or both, in response to an electrical signal. Gas generators 106 preferably are standard, commercial, off-the-shelf automotive air bag inflators, and most preferably, hybrid gas generators. Equally acceptable, newer hybrid gas generators are of the boosted-argon-hybrid type. Pyrotechnic gas generators may also be used. Each automotive hybrid gas generator is a small, high pressure, high reliability flask that contains a quantity of an inert gas, such as Argon, under pressure. On ignition, a small solid propellant such as sodium azide (Arcite) burns and generates a gas which mixes with the Argon in the vessel to heat it. A seal of the pressure vessel containing argon is either burned, burst, or ruptured using a piston. The gas from the propellant is mixed with the argon gas and escapes through a thrust-neutralized port. Roughly one half the energy comes from the solid propellant. A typical hybrid gas generator produces about twenty-five kilojoules of energy. Such hybrid gas generators are readily available and are produced by several vendors, such as Bendix Atlantic Inflator Company (now owned by Atlantic Research Corporation). Typical, acceptable, gas generators and their methods of operation are described in one or more of the following patents, the contents of which are expressly incorporated herein by reference: U.S. Pat. Nos. 3,723,205; 3,756,621; 3,895,821; 5,033,772; 5,076,607; 5,345,876; 5,577,769; 5,589,141; 5,601,310; 5,747,730; 5,763,821; 5,850,053; 5,861,571; and 5,997,666. An acceptable Bendix inflator is sold under the following part number: DOT E-1149413575. Characteristics of such an acceptable inflator are set forth in FIG. 12.

Such automotive hybrid gas generators are extremely desirable because they are each built to standards that are set by the automotive industry and that exceed military standards for reliability. Such generators meet military-like specifications for longevity, impact and insensitivity as munitions. The combustion product which is an argon-gas mix is benign. The firing readiness of such hybrid gas generators does not degrade over time. Shelf life of these generators is at least twenty years with no maintenance or inspection required.

As indicated, any number of gas generators 106 may be used in this invention. While four gas generators 106 are shown for purposes of illustration, a smaller or larger number could be used, depending upon the performance desired. Moreover, gas generators 106 could be fired sequentially, simultaneously, or in any combination thereof as is necessary to produce the desired exit velocity and acceleration forces for torpedo 18. Preferably, the number of gas generators 106 and the time delay between inflator firings are selected to replicate the pressure wave created by the prior art air flask. For most applications of this technology to lightweight torpedoes launched from a surface ship where the torpedo is less than 21 inches in diameter and weighs 450–800 pounds, the minimum velocity upon exit of the torpedo from end 12 of tube 10 is about 33 feet/sec. and the maximum acceleration should not exceed 20 g's. Typically, to achieve these results, either three or four gas generators are used, and the time delay between firing of the gas generators is about 20 milliseconds, although time delays of 20, 30 and 40 milliseconds have been used. The greater the number of gas generators used, typically the greater the acceleration and exit velocity. The acceleration and exit velocity also can be increased by decreasing the time delay between firings.

Figure 14:
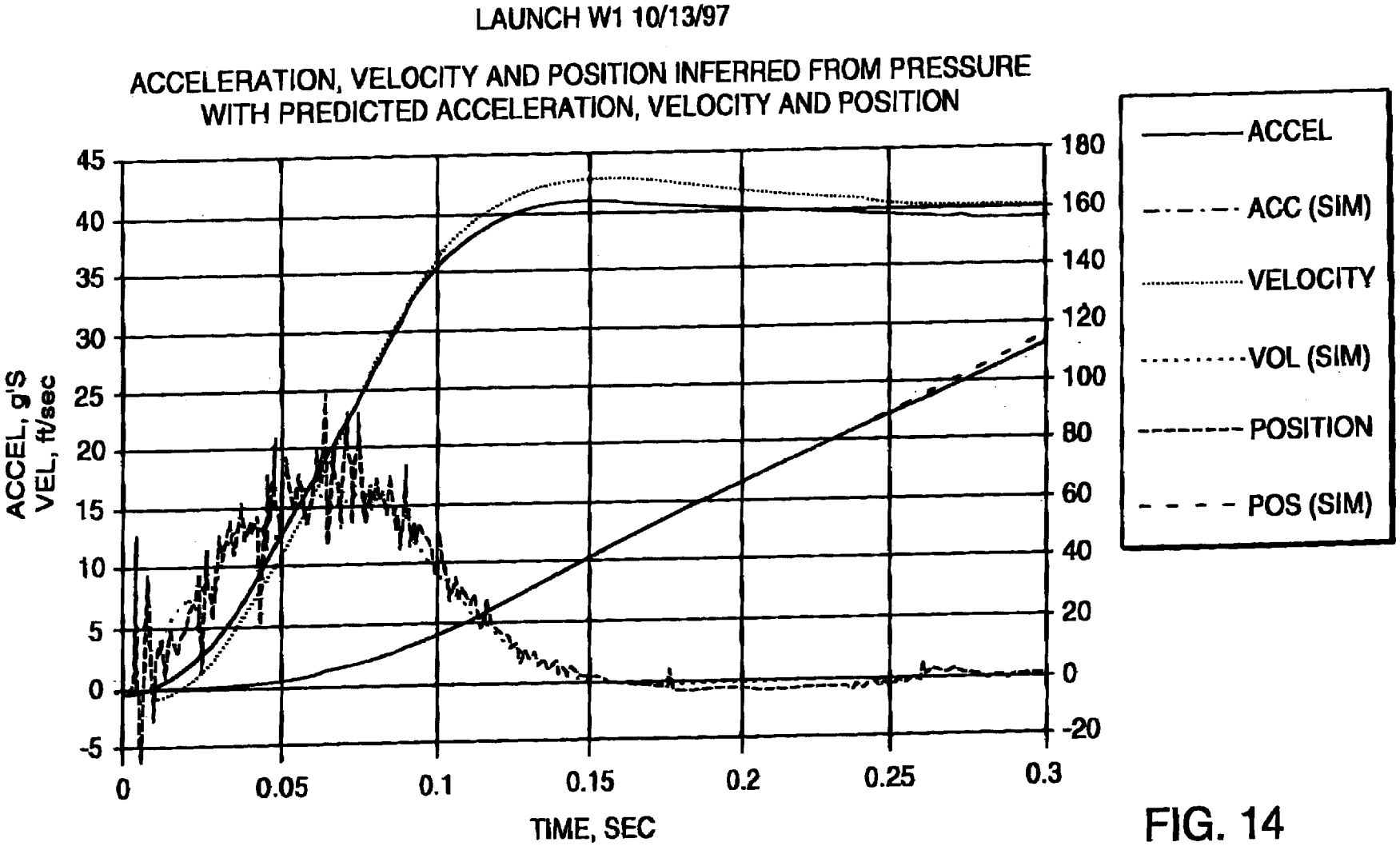

Test results are set forth in FIG. 13. As can be sees, test 1 used an unballasted MK50 torpedo weighing 419 lbs. Four gas generators were used, and the time delay was 20 milliseconds. Actual measured exit velocities were about 43.1 feet per second. FIG. 14 discloses in graphic form the acceleration, velocity and position of the torpedo with time for launch 1.

Figure 15:
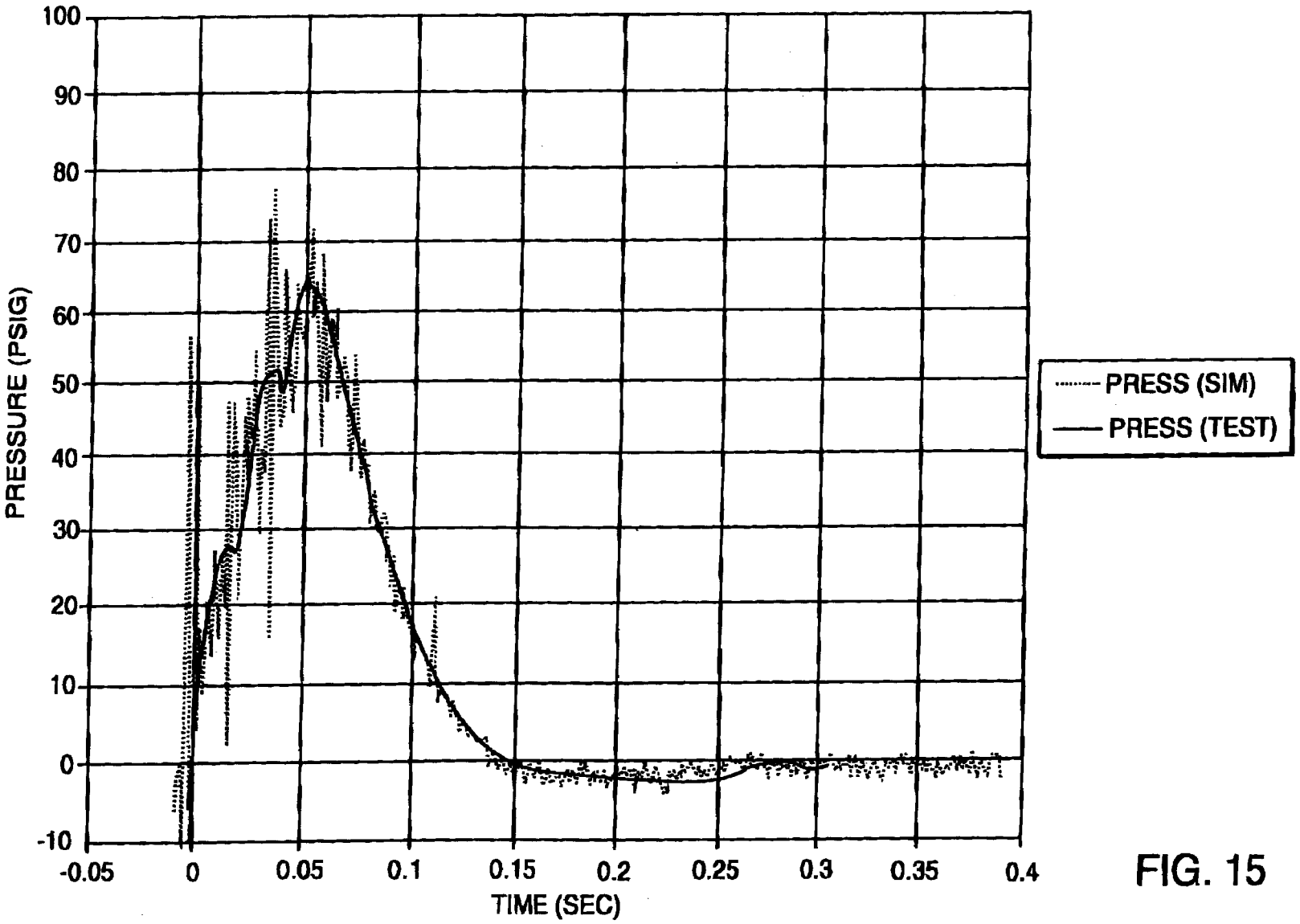

Launch 2 utilized an MK46 torpedo and three gas generators. The time delay for the gas generators was again 20 milliseconds. The exit velocity was measured at somewhere between 33.4 and 35.5 feet per second with the peak acceleration being 18 g's. FIG. 15 provides in graphic form the internal tube pressure in pounds per square inch versus time generated by the gas generators for a preferred launch profile.

Launch 3 was essentially identical to launch 2 in all respects and generated actual exit velocities of about 32.3 feet per second and peak accelerations of about 17 g's.

Launch 4 again used an MK46 torpedo. However, this time four gas generators were used with 20 millisecond delays. The peak exit velocity was between 44.2 and 45.6 feet per second. It was noted that this launch produced the most pressure, temperature and exit velocity on the MK46. However, even with four gas generators, the peak acceleration generated was no higher than that with three gas generators as used in launch 2. While the peak temperature was measured to be as high as 260° F, no physical damage was noted.

Launch 5 utilized an MK50 torpedo with four gas generators and a 20 millisecond delay. The quadrants were shimmed, thus reducing the blow-by area by 2.1 square inches. As a result, the measured exit velocity was between 52 and 52.4 feet per second, much greater than for launch 1 which utilized the same torpedo, but in which the quadrants were not shimmed.

Launch 6 was identical to launch 4, but varied the gas generator ignition intervals to decrease the acceleration on the MK46 torpedo. Time delays of 20, 30 and 40 milliseconds were utilized. Exit velocities ranging between 39.2 and 41.8 feet per second were observed. A peak acceleration of only 12 g's was generated.

Launch 7 used an MK46 torpedo and four gas generators. The time delay between the firings of the first two gas generators was 40 milliseconds, the time delay between the next two gas generators was 30 milliseconds; and the time delay between the last two gas generators was 20 milliseconds. An exit velocity of 37.31 feet/second was observed.

Launch 8 used an MK50 torpedo with four gas generators with a constant 20 millisecond time delay. An exit velocity of 31.26 feet/second was observed. Both launches 7 and 8 used an actual exercise torpedo which was fired from a barge in the water and both launches validated the desired water entry angle and speed.

The method of operation of the improved breech of this invention will now be described with particular reference to FIGS. 3–9 and with reference to launching of a torpedo. As shown in FIG. 3, prior to launch, torpedo 18 rests in tube 10 and is restrained by jaws 32 of weapons securing mechanism 24. Plug 54 is inserted into the female receptacle in torpedo 18 which is used for programming the torpedo. Upon commencement of the launch sequence, closure 16 is opened. A signal is sent to controller 134. Controller 134 in turn sends an electrical signal via cables 132 through cable transit 130 to initiator 142 which is fired to release gases through port 27 moving cylinder 31 to the left as shown in FIG. 2, causing jaws 32 to open. At approximately the same time, an electrical signal is sent to cylinder 152, which can either be a pneumatically operated cylinder or an electrically operated cylinder, such as a solenoid. Cylinder 152 retracts arm 154 and thus umbilical cable 52 from torpedo 18. At approximately the same time, controller 134 sends a series of discretely timed signals to sequentially fire gas generators 106. The delay between the release of jaws 32 and the activation of cylinder 152, and the firing of the gas generators 106 typically is on the order of milliseconds. The firing sequence has been pre-programmed or hardwired into controller 134, although in an alternative embodiment, controller 134 could be programmable. Preferably, four gas generators 106 are used, and the gas generators are fired sequentially with a delay of about 20 milliseconds between each one. Typically, although not necessarily, to achieve a balanced generation of pressure within tube 10, the firing sequence is as follows: generator 106*a,* generator 106*d,* generator 106*b* and generator 106*c*. However, other sequences, arrangements and timing delays could be used as desired to produce the desired exit velocity, acceleration forces and pressure within tube 10. As gas generators 106 release gases within tube 10, a back pressure develops behind the midsection of the torpedo. This pressure buildup is due to the relatively tight tolerances between the outer surface of the torpedo 18 and the inner surfaces of tube 10. The pressure buildup behind the tail of torpedo 18 increases until the torpedo begins to move forward and is ejected at a specific, controllable exit velocity as set forth above in the launch examples. Once out of the tube 10, torpedo 18 is propelled in a conventional manner which is well-known in the art and will not be further discussed herein.

Upon completion of the launch, breech plate 102, flange 110, and breech cover 108 are removed as a unit. Breech plate 102 and flange 110 are held stationary by means of handle 116. Latch and bracket assembly 123 are released and locking ring assembly 115 is rotated about 22.5 degrees in a clockwise direction, as shown in FIG. 11, or until assembly 115 is in its unlocked position in which locking elements 114 are disposed between locking elements 117. Ball detents on grip handle 121 tell the operator when assembly 115 is in the unlocked position and grab and hold assembly 115 in the unlocked position. Since locking flange 110 is then released, flange 110 and plate 102 may be removed as a unit from breech end 14. In addition, weapons securing mechanism 24 is released by rotating handle 140 downwardly, as shown in FIG. 11, to retract pins 143 to release plates 144 from brackets 145. Mechanism 24 is then removed as a unit by manually grasping handle 140 and withdrawing mechanism 24 from brackets 145. A new torpedo 18 is inserted into tube 10 through breech end 14 and plug 54 is inserted into the female receptacle on torpedo 18. A new weapons securing mechanism 24 is installed with a fresh initiator 142 mounted therein. Alternatively, mechanism 24 is installed and hose 156 is connected to a device 155 or gas generator 106 mounted on breech plate 102. A combination of locking flange i 10 and breech plate 102 in which tubes 105 have been supplied with fresh gas generators 106 is installed and is covered by breech cover 108. Gas generators 106 are replaced simply by inserting them into tubes 105 through openings 120 after removal of covers 118.

The improved breech mechanism 100 of this invention has several advantages over the existing launch system used for light weight, surface-launched torpedoes. The use of gas generators 106 assures that the firing readiness of the breech does not degrade over time. Moreover, one need not worry about leakage of gas and the resultant injury to personnel which could result. The gas generators 106 are restrained within retaining device 104 and all gases emitted therefrom are directed toward the interior of tube 10, and not back toward the breech plate 102. Also, the pressure build-up is directed against the retaining device 104 and breech plate 102, and not against breech cover 108. Breech cover 108 is sealed from the interior of tube 10 by breech plate 102. Gas generators 106 can be replaced in a matter of minutes, as compared to one to one and one half hours it takes to recharge the flasks for all six torpedo tubes normally carried on a typical surface ship. Moreover, corrosion problems evident in the prior art flask are no longer an issue, and maintenance is reduced. The cost of the gas generators is quite low, decreasing the cost of ship operation. Since the gas generators are highly reliable and have a long shelf life, combat readiness is improved. Finally, the improved breech can be retrofitted onto existing tubes, and therefore can be adopted with little or no modification of the tubes of existing vessels.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. A vehicle launch assembly comprising:

a tube for holding a vehicle, said tube having a forward end and a rear end;

a firing mechanism disposed on said rear end of said tube for expelling the vehicle from said tube, said firing mechanism comprising a plurality of gas generators for releasing a gas into said tube;

a restraint device for holding said gas generators;

a cover for providing a substantially gas tight seal at said rear end of said tube;

a securing mechanism for restraining a vehicle, said mechanism including jaws for grasping a tail of the vehicle; and an electrically activated firing device for opening the jaws of the securing mechanism upon receipt of a signal.

2. The assembly as recited in claim 1, wherein said firing mechanism comprises at least three gas generators.

3. The assembly as recited in claim 2 further comprising a controller for sequentially firing the gas generators.

4. The assembly as recited in claim 1 wherein said firing device generates a gas upon receipt of a signal, and wherein said gas is directed to a mechanism for opening said jaws.

5. The assembly as recited in claim 4, further comprising a controller which provides an electrical signal to said firing device.

6. The assembly as recited in claim 1, further comprising:

a locking flange having a locking mechanism compatible with a locking assembly on an existing tube;

a breech plate mounted onto said locking flange, said breech plate including said restraint device; and a controller mounted to said breach plate for controlling operation of said gas generators.

7. The assembly as recited in claim 1 wherein said gas generator is an automotive air bag inflator.

8. A method of launching a vehicle from a tube comprising the steps of:

restraining the vehicle prior to launch;

releasing the vehicle from restraint;

firing a plurality of gas generators to generate sufficient gas pressure to propel the vehicle from the tube at a predetermined exit velocity and force;

firing the plurality of gas generators in a controlled timed sequence; and providing about a 20 millisecond time delay between the sequential firing of each successive gas generator.

9. The method as recited in claim 8, wherein four gas generators are used.

10. The method as recited in claim 8, wherein three gas generators are used.

11. The method as recited in claim 8, further comprising the step of electrically actuating a cylinder to remove an electrical connector plug from the vehicle prior to firing the gas generators.

12. The method as recited in claim 8, wherein the predetermined exit velocity of the vehicle is between 33.4 and 52.4 feet per second.

13. The method as recited in claim 8, further comprising the steps of:

after the vehicle has exited the tube, removing a breech cover to gain access to a device for holding the gas generators;

replacing the device with the fired gas generators with a new device having fresh gas generators; and replacing the breech cover.

14. The method as recited in claim 13, further comprising the step of replacing a firing device for opening jaws of a securing mechanism after the step of removing the breech cover and prior to the step of replacing the breech cover.

15. The method as recited in claim 8, wherein said releasing step comprises the step of firing an explosive device to generate a gas that is conducted to a mechanism for opening jaws holding the vehicle.

16. The method as recited in claim 15 further comprising the step of replacing the jaws holding the vehicle and the explosive device after launching a vehicle.

17. An assembly for launching lightweight torpedoes on surface ships comprising:

a tube for holding a torpedo, said tube having a forward end and a rear end;

a firing mechanism disposed on said rear end of said tube, said firing mechanism comprising a plurality of automotive air bag inflators;

a restraint device for holding said inflators;

a cover for providing a gas tight seal at said rear end of said tube;

a controller for sequentially firing the automotive air bag inflators to expel the torpedo from the forward end of said tube at a predetermined exit velocity;

a weapons securing mechanism for restraining a torpedo, said mechanism including jaws for grasping a tail of the torpedo; and an electrically activated firing device for generating a gas that is conducted to a mechanism for opening the jaws of the weapons securing mechanism.

18. A method of launching a lightweight torpedo from a tube on a surface ship comprising the steps of:

restraining the torpedo prior to launch;

releasing the torpedo from restraint;

sequentially firing with a controlled, timed sequence a plurality of automotive air bag inflators to generate a gas pressure sufficient to propel the torpedo from the tube at a predetermined exit velocity and force; and providing about a 20 millisecond time delay between each sequential firing of an inflator.

19. The method as recited in claim 18, wherein four inflators are used.

20. The method as recited in claim 18, wherein the exit velocity of the torpedo is between 33.4 and 52.4 feet per second.

21. A vehicle launch assembly comprising:

a tube for holding a vehicle, said tube having a forward end and a rear end;

a firing mechanism disposed on said rear end of said tube for expelling the vehicle from said tube, said firing mechanism comprising a plurality of gas generators for releasing a gas into said tube;

a restraint device for holding said gas generators;

a locking flange having a locking mechanism compatible with a locking assembly on an existing tube;

a breech plate mounted onto said locking flange, said breech plate including said restraint device;

a controller mounted to said breech plate for controlling operation of said gas generators; and a removable cover covering said breech plate.

22. The assembly as recited in claim 21, further comprising a cylinder operable to retract an electrical connector plug from a vehicle upon receipt of a signal from said controller.

23. A method of launching a vehicle from a tube comprising the steps of:

restraining the vehicle prior to launch;

releasing the vehicle from restraint, said releasing step comprising the step of firing an explosive device to generate a gas that is conducted to a mechanism for opening jaws holding the vehicle; and firing a plurality of gas generators to generate sufficient gas pressure to propel the vehicle from the tube at a predetermined exit velocity and force.

24. A method of launching a vehicle from a tube comprising the steps of:

restraining the vehicle prior to launch;

releasing the vehicle from restraint;

firing a plurality of gas generators to generate sufficient gas pressure to propel the vehicle from the tube at a predetermined exit velocity and force; and electrically actuating a cylinder to remove an electrical connector plug from the vehicle prior to firing the gas generators.

25. A vehicle launch assembly comprising:

a tube for holding a vehicle, said tube having a forward end and a rear end;

a firing mechanism disposed on said rear end of said tube for expelling the vehicle from said tube, said firing mechanism comprising a plurality of gas generators for releasing a gas into said tube;

a restraint device for holding said gas generators;

a cover for providing a gas tight seal at said rear end of said tube;

a controller for controlling operation of said gas generators; and a cylinder operable to retract an electrical connector plug from a vehicle upon receipt of a signal from said controller.

* * * * *